US011000167B2

(12) United States Patent
Zhou

(10) Patent No.: US 11,000,167 B2
(45) Date of Patent: May 11, 2021

(54) VACUUM CLEANER AND CONTROL METHOD THEREOF

(71) Applicant: TINECO APPLIANCES CO., LTD., Suzhou (CN)

(72) Inventor: Dehua Zhou, Suzhou (CN)

(73) Assignee: TINECO APPLIANCES CO., LTD., Suzhou (CN)

( * ) Notice: Subject to any disclaimer, the term of this patent is extended or adjusted under 35 U.S.C. 154(b) by 139 days.

(21) Appl. No.: 16/041,560

(22) Filed: Jul. 20, 2018

(65) Prior Publication Data

US 2019/0021567 A1 Jan. 24, 2019

(30) Foreign Application Priority Data

Jul. 21, 2017 (CN) ..... 201710600105.4

(51) Int. Cl.
*A47L 9/28* (2006.01)
*A47L 9/04* (2006.01)

(52) U.S. Cl.
CPC ..... *A47L 9/2831* (2013.01); *A47L 9/0411* (2013.01); *A47L 9/2847* (2013.01); *A47L 9/2889* (2013.01); *A47L 9/04* (2013.01)

(58) Field of Classification Search
CPC ..... A47L 9/04; A47L 9/0411; A47L 9/2831; A47L 9/2847; A47L 9/2889
See application file for complete search history.

(56) References Cited

U.S. PATENT DOCUMENTS

| | | | | |
|---|---|---|---|---|
| 6,042,656 | A | 3/2000 | Knutson | |
| 7,237,298 | B2 | 7/2007 | Reindle et al. | |
| 9,301,665 | B2 | 4/2016 | Clothier et al. | |
| 2005/0065662 | A1 | 3/2005 | Reindle et al. | |
| 2006/0101605 | A1 | 5/2006 | Fujiwara | |
| 2010/0037418 | A1 | 2/2010 | Hussey et al. | |
| 2014/0366306 | A1* | 12/2014 | Clothier | A47L 9/2842 15/319 |

FOREIGN PATENT DOCUMENTS

| | | | |
|---|---|---|---|
| CN | 1308915 | A | 8/2001 |
| CN | 1771878 | A | 5/2006 |

(Continued)

OTHER PUBLICATIONS

CN 105030147 A—English Machine Translation (Year: 2015).*

(Continued)

*Primary Examiner* — Marc Carlson
(74) *Attorney, Agent, or Firm* — Maschoff Brennan

(57) ABSTRACT

A vacuum cleaner and a control method thereof, wherein the vacuum cleaner includes a vacuum cleaner body, a floor brush assembly, and an extension tube connecting the two together. The floor brush assembly comprises a plurality of different floor brushes for performing different cleaning work. The vacuum cleaner is further provided with a control unit and a detection unit. The detection unit comprises a floor brush current detection module for detecting current passing through an electric motor in a floor brush. The floor brush current detection module sends detection signals to the control unit, and the control unit controls the electric motor to maintain an operating state or stop the operating state according to the detection signals.

12 Claims, 3 Drawing Sheets

(56) References Cited

FOREIGN PATENT DOCUMENTS

| | | | | | |
|---|---|---|---|---|---|
| CN | 101083932 | A | | 12/2007 | |
| CN | 101756677 | A | | 6/2010 | |
| CN | 102392576 | A | | 3/2012 | |
| CN | 105030147 | A | * | 11/2015 | |
| CN | 105030147 | A | | 11/2015 | |
| CN | 105491932 | A | | 4/2016 | |
| CN | 106343921 | A | | 1/2017 | |
| JP | H04-261624 | A | | 9/1992 | |
| JP | 2012217787 | A | * | 11/2012 | |
| WO | 2016/096046 | A1 | | 6/2016 | |
| WO | WO-2016096046 | A1 | * | 6/2016 | ..... A47L 9/2805 |

OTHER PUBLICATIONS

CN Office Action in Application No. 201710600105.4 dated Feb. 3, 2020.
CN Office Action in Application No. 201710600105.4 dated Jul. 27, 2020.
CN Office Action in Application No. 201710600105.4 dated Nov. 17, 2020.
EP Search Report in Application No. 18834759.5 dated Feb. 22, 2021.

* cited by examiner

VACUUM CLEANER AND CONTROL METHOD THEREOF

TECHNICAL FIELD

The present disclosure relates to a vacuum cleaner and a control method thereof, belonging to the technical field of small household appliance manufacturing.

BACKGROUND ART

In order to meet the different cleaning needs of users, there are a large variety of accessory floor brushes for existing vacuum cleaners. Since different floor brushes have different functions, the electric motors may generally have different operating currents. When an over-current point is used to determine whether the electric motor of a floor brush is in a stall state, if the electric motor of the floor brush is a large-current motor, false protection will occur, and if the electric motor of the floor brush is a small-current motor, stalling and no protection will occur. With the above technical solution, the vacuum cleaner is unstable in overall operation and has potential safety hazards.

SUMMARY

One embodiment of the present disclosure provides a vacuum cleaner comprising a vacuum cleaner body provided with a control unit and a detection unit; a floor brush assembly comprising a plurality of different floor brushes for performing different types of cleaning work; an extension tube connecting the vacuum cleaner and the floor brush, wherein the detection unit comprises a floor brush current detection module for detecting a current passing through an electric motor in a floor brush of the plurality of different floor brushes, wherein the floor brush current detection module sends the detected current to the control unit, and the control unit controls the electric motor to maintain an operating state or stop the operating state according to the current detected by the floor brush current detection module Another embodiment of the present disclosure provides a control method of a vacuum cleaner, the method comprising:

detecting a start peak current and a normal operating current passing through the electric motor of a floor brush which is being used in the vacuum cleaner;

performing matching in preset correspondences between the start peak current ranges and the stall currents of a plurality of floor brushes in a floor brush assembly according to the start peak current so as to determine a stall current corresponding to the floor brush which is being used; and controlling the electric motor to maintain an operating state or stop according to the normal operating current and the stall current corresponding to the floor brush which is being used.

SPECIFIC EMBODIMENTS

An embodiment of the present disclosure provides a vacuum cleaner which comprises a vacuum cleaner body, a floor brush assembly, and an extension tube connecting the two together. The floor brush assembly comprises a plurality of different floor brushes for performing different cleaning functions. Each floor brush is provided with an electric motor. When a floor brush operates, the electric motor on the floor brush is connected to a main electric motor which is disposed on the vacuum cleaner body which is used for driving a cleaning unit on the floor brush to perform cleaning work. During the cleaning work, a stall condition might occur due to the floor brush being entangled with hair, leading to unstable operation of the whole vacuum cleaner and potential safety hazards with easy damage of the vacuum cleaner. For this problem, it would be necessary to detect the stall condition of the electric motor.

In view of different functions of different types of floor brushes, electric motors thereon may have different operating currents and different stall currents. In order to allow for stall detection on electric motors on different floor brushes by a unified method when the different floor brushes operate, a control unit and a detection unit are disposed on the vacuum cleaner main body in this embodiment. The detection unit comprises a floor brush current detection module for detecting the current passing through the electric motor of the floor brush which is being used and sending the detected current to the control unit. The control unit is used for receiving the current from the floor brush current detection module and controlling the electric motor the electric motor to maintain an operating state or stop according to the detected current. In this way, the problem of unstable operation of the whole machine can be avoided as much as possible, which is conducive to eliminating potential safety hazards.

In this embodiment, the type of the vacuum cleaner is not limited. For example, it can be an upright vacuum cleaner, a horizontal vacuum cleaner, a hand-held vacuum cleaner or the like. A hand-held vacuum cleaner will be illustrated by way of example in the following embodiment and accompanying drawings thereof.

Figure 1:
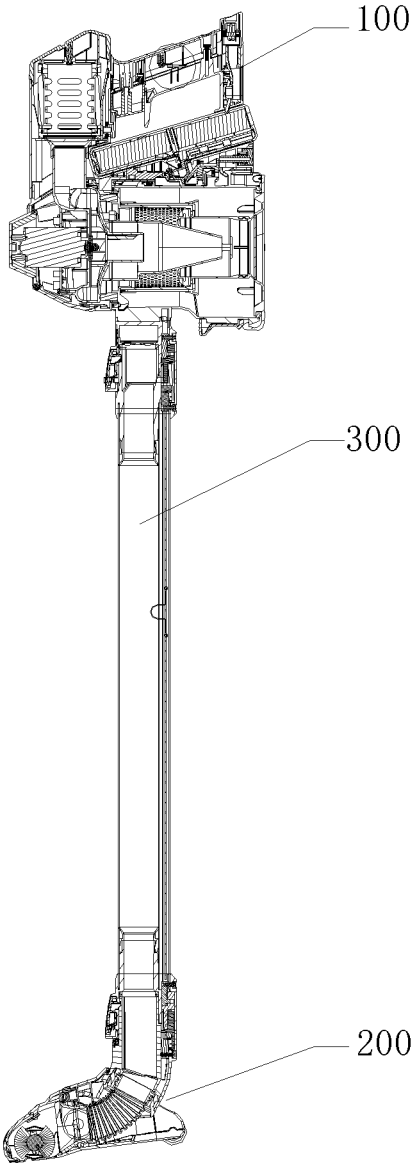
FIG. 1 is a structural schematic diagram of a hand-held vacuum cleaner provided by an embodiment of the present disclosure.

FIG. 1 is a structural schematic diagram of a hand-held vacuum cleaner provided by an embodiment of the present disclosure. As shown in FIG. 1, the hand-held vacuum cleaner provided by this embodiment of the present disclosure comprises a vacuum cleaner body 100, a floor brush assembly 300, and an extension tube 200 connecting the two together, wherein the floor brush assembly 300 comprises a plurality of different floor brushes for performing different types of cleaning work to improve the cleaning function of the hand-held vacuum cleaner. Each floor brush is provided with an electric motor and a cleaning unit, wherein the electric motor is used for driving the cleaning unit to operate.

Optionally, the floor brush can be a round-head floor brush, and the cleaning unit thereof is a small suction nozzle which can be used for cleaning furniture, fine mesh fabrics and the like when driven by the electric motor to operate. Optionally, the floor brush can be a crevice nozzle floor brush, and the cleaning unit thereof is a crevice nozzle which can be used for cleaning narrow places such as wall edges, radial finned radiators, corners and the like when driven by the electric motor to operate. Optionally, the floor brush can be a roller floor brush, and the cleaning unit thereof is a roller which is made of long and soft bristles and the like, and is suitable for cleaning curtains, walls, etc.

The vacuum cleaner is further provided with a vacuum unit, a control unit, a detection unit and the like, with the detection unit being electrically connected with the control unit by a wire or a communication line, wherein the vacuum unit is used for generating suction, while the control unit is used for controlling the operation of the hand-held vacuum cleaner, and the detection unit is used for detecting the state of the hand-held vacuum cleaner, the operating environment and so on. In addition, the detection unit is further used for sending detected information to the control unit, so that the control unit controls the operating state of the hand-held vacuum cleaner according to the received information. In this embodiment of the present disclosure, the hand-held vacuum cleaner generates suction through the vacuum unit and sucks garbage such as dust, scraps of paper and hair on the surface to be cleaned through the floor brush assembly 300, and the garbage such as dust, scraps of paper and hair enters a collection unit in the vacuum cleaner body 100. Optionally, the vacuum cleaner body 100 comprises (but is not limited to): a main body housing, a hand-held terminal, a power supply assembly, a collection unit, a main body circuit and the like, wherein the main body circuit comprises a main electric motor. The collection unit can be a dust cup, a dust barrel, a dust bag or the like.

Optionally, the hand-held terminal is disposed on the main body housing, preferably in a position which is convenient for human hand to hold on the main body housing, and the collection unit may be disposed on one side of the hand-held terminal. In addition, the power supply assembly may be disposed on a lower portion of the hand-held terminal. An output end of the power supply assembly is connected to the main body circuit for supplying power thereto and driving the main electric motor to operate.

Optionally, in addition to the main electric motor, the main body circuit may also comprise a detection unit and a control unit, wherein the detection unit may comprise a floor brush current detection module. In particular, when a floor brush is mounted on the extension tube 200, the floor brush current detection module is electrically connected with an electric motor of the floor brush to detect the current passing through the electric motor of the floor brush. The electric motor of the floor brush is supplied with power by the main body circuit. Accordingly, a wire is disposed between the main body circuit and the floor brush, so that the current in the main body circuit is transported to the electric motor of the floor brush through the wire, thereby powering the electric motor to drive the cleaning unit of the floor brush to rotate.

Certainly, the floor brush current detection module can also be disposed in a particular position of the extension tube 200 apart from being disposed in the main body circuit, and electrically connected with the main body circuit through a wire or a communication line. For example, the floor brush current detection module may be disposed on an end portion, abutting against a floor brush, of the extension tube 200, thereby facilitating electrical connection of the floor brush current detection module with the electric motor of the floor brush.

Optionally, a detection point can be drawn from a power supply line, used for supplying power to the electric motor of a floor brush, of the main body circuit, and the floor brush current detection module may be connected to the detection point to detect the current passing through the electric motor of the floor brush.

Optionally, the extension tube 200 can be a telescopic extension tube that can be freely adjusted in length. To be in harmony with the adjustable length of the extension tube 200, the above-mentioned wire or communication line has tensile elasticity. Preferably, the wire or the communication line is a spiral spring wire or a spiral spring communication line, and may stretch out and draw back along with the length adjustment of the extension tube 200.

Figure 2:
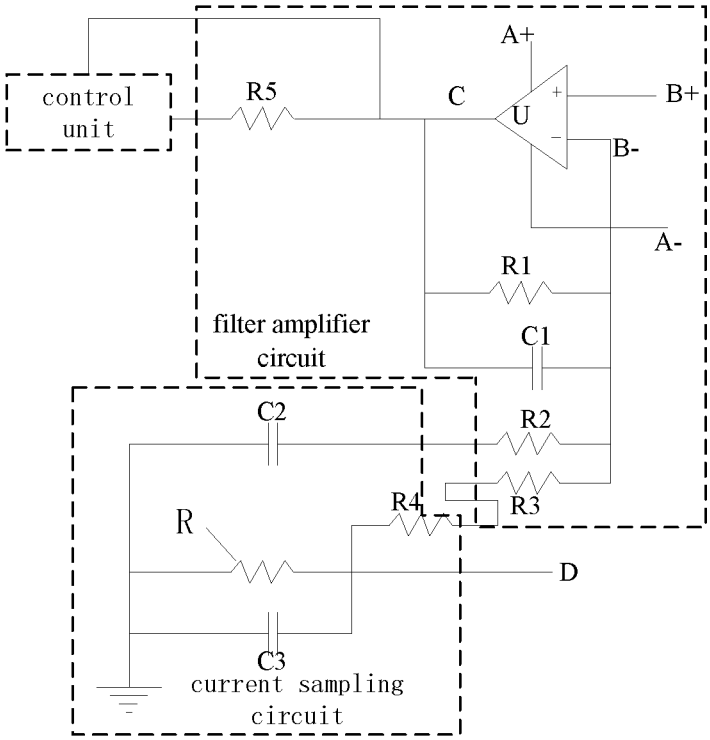
FIG. 2 is a circuit schematic diagram of a floor brush current detection module.

In an embodiment of the present disclosure, the detection unit comprises a floor brush current detection module for detecting the current passing through the electric motor of a floor brush and sending the detected current to the control unit. Then, the control unit may determine the type of the floor brush according to the detected current and control the electric motor to maintain the operating state or stop. FIG. 2 is a circuit schematic diagram of a floor brush current detection module. As shown in FIG. 2, the current of the electric motor of a floor brush can be obtained by measuring the voltage across a sampling resistor R.

The operating principle of a floor brush current detection circuit shown in FIG. 2 will be explained below. As shown in FIG. 2, the floor brush current detection circuit comprises a current sampling circuit and a filter amplifier circuit. A sampling resistor R in the current sampling circuit has one end grounded and the other end electrically connected with the electric motor of the floor brush and is used for converting the current passing through the electric motor of the floor brush into a voltage signal. The current sampling circuit further comprises capacitors C2 and C3, and a resistor R4 connected in series with the capacitor C3. The filter amplifier circuit comprises an operational amplifier U. Power input ports A+ and A− of the operational amplifier U are connected to positive and negative poles of a power source, respectively. An in-phase input port B+ of the operational amplifier U is coupled to a voltage of a fixed value for enabling the operational amplifier U to output a constant voltage, while an inverted voltage input port B− is connected in parallel to the resistors R2 and R3, respectively. The other end of the resistor R2 is connected to the capacitor C2, and the other end of the capacitor C2 is grounded. The other end of the resistor R3 is connected to the resistor R4, and the capacitor C3 connected in series with the resistor R4 is grounded. An RC parallel circuit which is formed by connecting a resistor R1 with a resistor C1 in parallel is further connected in series between the inverted voltage input port B− and the output port C of the operational amplifier U. The output port C of the operational amplifier U is connected in series with a resistor R5 and then electrically connected to the control unit.

The operating principle of the current sampling circuit as shown in FIG. 2 is as follows: the sampling resistor R collects a current signal passing through the electric motor of the floor brush and converts the current signal into a voltage signal. The voltage signal is output to the inverted voltage input port B− of the operational amplifier U after being filtered by the capacitors C2 and C3. After voltage amplification of the voltage signal by the operational amplifier, the amplified voltage signal is output to the control unit via the output port C of the operational amplifier U, so that the control unit calculates the current passing through the electric motor of the floor brush based on the voltage signal and the sampling resistor R. In particular, the amplification factor of the operational amplifier U is decided by the resistor R1, the resistor R3 and the resistor R4. Optionally, the resistor R3 and the resistor R4 can be adjustable resistors; thus, the amplification factor of the operational amplifier U may be adjusted by adjusting the values of resistance of the resistor R3 and the resistor R4.

Specifically, the hand-held vacuum cleaner is equipped with a plurality of floor brushes of different types. Since different floor brushes perform different cleaning functions, the electric motors of the floor brushes have different stall currents and start peak currents, and a fixed correspondence is provided between each of those stall currents and the start peak currents. To ensure an accurate correspondence between the stall currents and the start peak currents, the correspondence between the two may be obtained by an actual measurement method. For example, the stall current of an electric motor is A, and in this case, the start peak current of the electric motor is detected multiple times, obtaining that the start peak current of the electric motor within a start peak duration t (e.g., 0-20 milliseconds (ms), preferably 10 ms, but not limited hereby in the embodiment of the present disclosure) is within a range of a1 to a2, i.e., the stall current A of the electric motor corresponds to the start peak current range a1-a2. That is, when the floor brush current detection module detects that the start peak current A of the electric motor of the floor brush ranges from a1 to a2, the stall current of the electric motor of the floor brush is determined to be A.

Optionally, the start peak current range a1-a2 can also be corrected for corresponding to the stall current A. The specific correspondence between the start peak current range and the stall current A is not limited in the embodiment of the present disclosure, so long as non-overlapping of the start peak current ranges of a plurality of electric motors can be guaranteed and a corresponding start peak current range is provided for the stall current of the electric motor of each floor brush. In particular, the start peak current range a1-a2 may be corrected by methods such as, but not limited to, equivalent interpolation, proportional interpolation, trend deviation, and weighted average.

In an alternative embodiment, the above measured correspondence between the start peak current range and the stall current of the electric motor of each of a plurality of floor brushes in the floor brush assembly 300 can be preset in the control unit. Alternatively, the above measured correspondence between the start peak current range and the stall current of the electric motor of each of a plurality of floor brushes in the floor brush assembly 300 can be stored in a storage module in the main body circuit, and the control unit can preload the correspondence from the storage module before use.

In some application scenarios, when the cleaning unit of a floor brush stops operating due to an external force, for example, the cleaning unit stops rotating due to the cleaning unit being entangled with hair, the circuit of the floor brush idles, and the current passing there through in this condition is greater than or equal to the stall current, which may cause burnout of the electric motor.

Regarding the above application scenarios, the hand-held vacuum cleaner provided by the embodiment of the present disclosure may first measure the start peak current when a certain floor brush (i.e., the floor brush which is being used) is started (such as within 10 ms) by means of the floor brush current detection module and send the start peak current to the control unit. Then, the control unit may determine the stall current of the floor brush according to the start peak current as well as the preset start peak current ranges and the stall currents of the electric motors of a plurality of floor brushes. When the electric motor of the floor brush operates stably, or rather after the start peak current maintains a period of time (the duration t, for example, 10 ms, of the start peak current), the floor brush current detection module may continuously detect the normal operating current of the electric motor of the floor brush and transmit the normal operating current to the control unit. Subsequently, the control unit may control the electric motor to maintain the operating state or stop according to the measured normal operating current and the stall current of the electric motor. For example, if the normal operating current is larger than or equal to the stall current, the control unit may control the electric motor to cause it to stop. If the normal operating current is smaller than the stall current, the control unit may control the electric motor to maintain the operating state. When there is a need to control the electric motor to stop, the control unit can control the main electric motor to stop supplying power to the electric motor of the floor brush, causing the electric motor of the floor brush to stop so as to prevent burnout of the electric motor. It needs to be noted that the normal operating current mentioned in each embodiment of the present disclosure does not imply that the operation of the electric motor of a floor brush is not abnormal, and is so called merely for the convenience of description before determining whether the operation of the electric motor is abnormal.

Figure 3A:
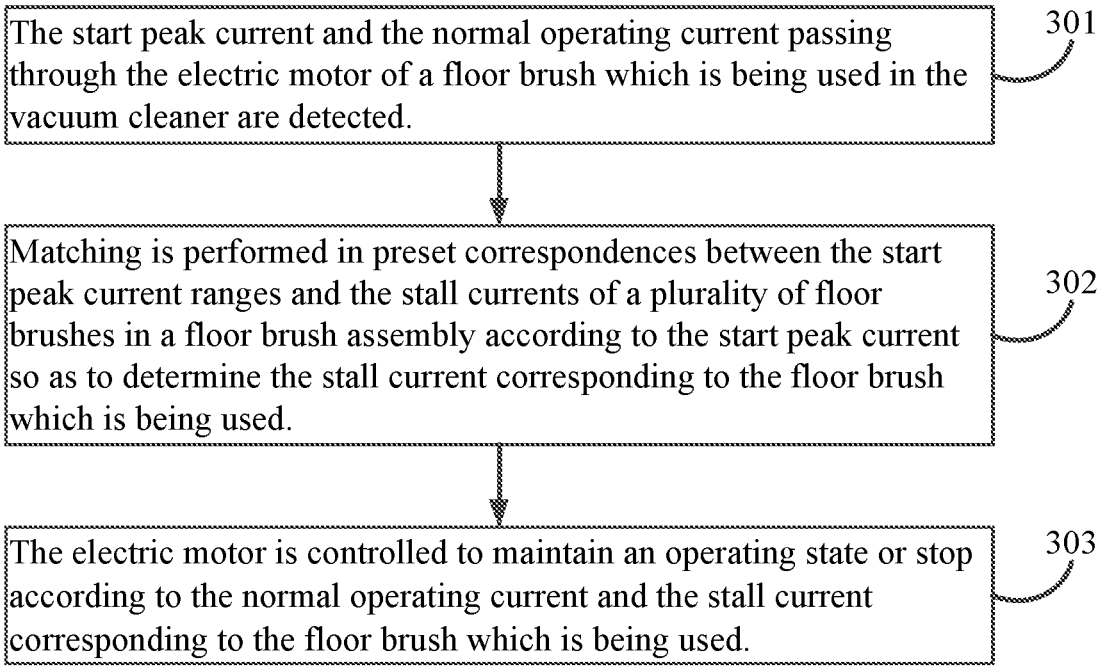
FIG. 3*a* is a flowchart of a control method of a vacuum cleaner provided by an embodiment of the present the present disclosure.

In addition to the above vacuum cleaner, an embodiment of the present disclosure further provides a control method of a vacuum cleaner. FIG. 3*a* is a flowchart of a control method of a vacuum cleaner provided by an embodiment of the present disclosure. As shown in FIG. 3*a*, the control method comprises the following steps.

At step 301, the start peak current and the normal operating current passing through the electric motor of a floor brush which is being used in the vacuum cleaner are detected.

At step 302, matching is performed in preset correspondences between the start peak current ranges and the stall currents of a plurality of floor brushes in a floor brush assembly according to the start peak current so as to determine the stall current corresponding to the floor brush which is being used.

At step 303, the electric motor is controlled to maintain an operating state or stop according to the normal operating current and the stall current corresponding to the floor brush which is being used.

Optionally, one implementation of step 301 may comprise: detecting the start peak current of the electric motor of the floor brush which is being used within a start peak duration (t) when the electric motor of the floor brush which is being used is started; and detecting the normal operating current of the electric motor of the floor brush which is being used after the start peak duration (t). Optionally, one implementation of step 303 may comprise: controlling the electric motor to stop if the normal operating current is larger than or equal to the stall current corresponding to the floor brush which is being used; and controlling the electric motor to maintain the operating state if the normal operating current is smaller than the stall current corresponding to the floor brush which is being used.

Optionally, before step 302, the method may also comprise: initializing, and preloading the correspondences between the start peak current ranges and the stall currents of the plurality of floor brushes in the floor brush assembly.

In this embodiment, the vacuum cleaner can automatically determine the type of the electric motor of the floor brush at the moment of starting according to the start peak current of the electric motor of the floor brush and the preset correspondence between the start peak current range and the stall current, so as to provide the stall current corresponding to the electric motor, and thus can control the electric motor to continue normal operation or stop operating according to a relationship between the detected normal operating current and the stall current. As a result, the problem of unstable operation of the whole machine can be avoided as much as possible, which is conducive to eliminating potential safety hazards.

Figure 3B:
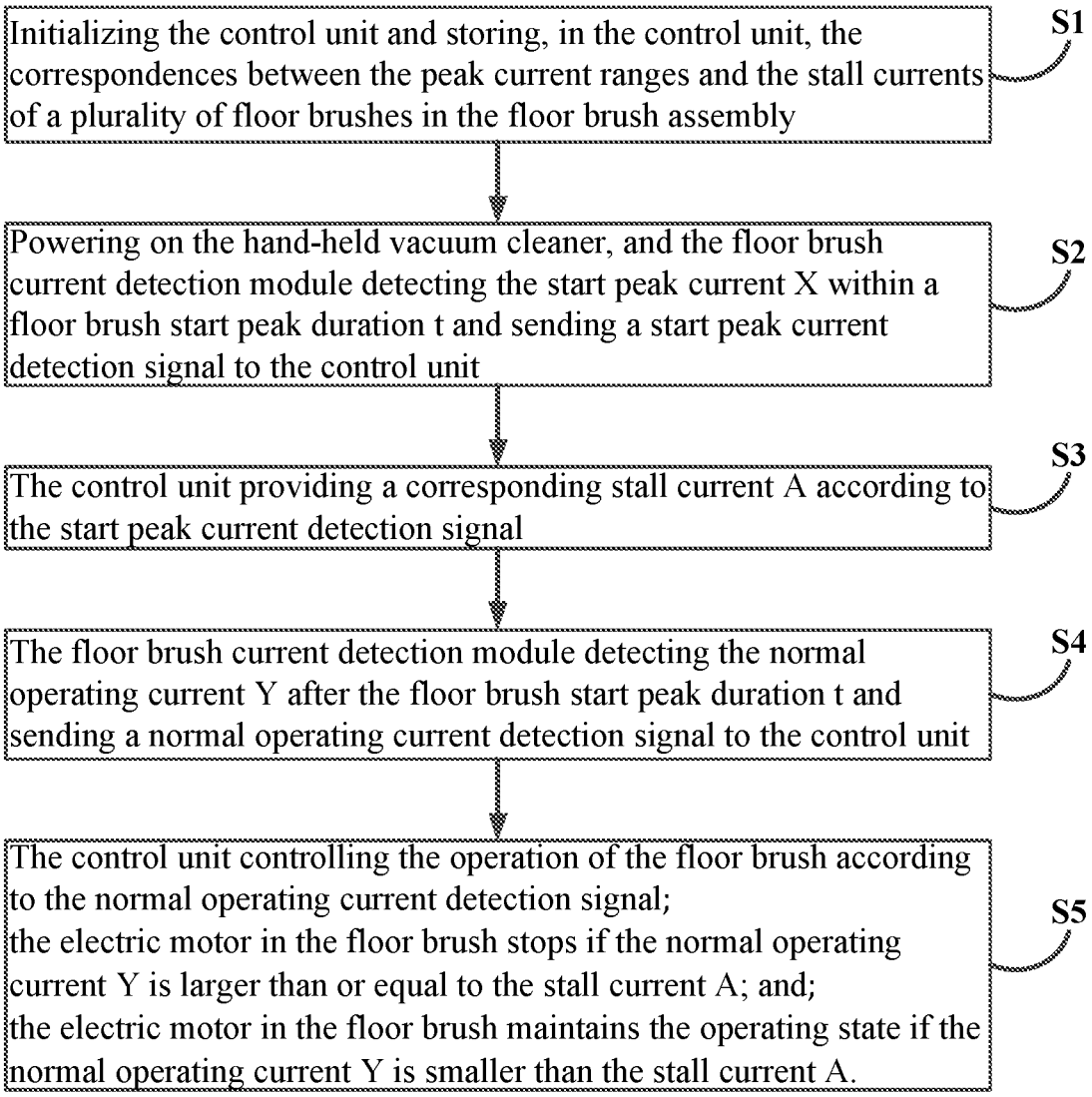
FIG. 3*b* is a flowchart of a control method of a hand-held vacuum cleaner provided by an embodiment of the present disclosure

The control method of a vacuum cleaner provided by the embodiment of the present disclosure can be applied to the vacuum cleaner provided by the foregoing embodiment. For example, the floor brush current detection module and the control unit of the vacuum cleaner described above may be used in combination with the embodiment, which may not be limited thereby. FIG. 3*b* illustrates an application process of a control method of a hand-held vacuum cleaner provided by an embodiment of the present disclosure in the vacuum cleaner provided by the foregoing embodiment, which specifically comprises the following steps:

S1: initializing the control unit and storing, in the control unit, the correspondences between the peak current ranges and the stall currents of each of a plurality of floor brushes in the floor brush assembly;

S2: powering on the hand-held vacuum cleaner, and the floor brush current detection module detecting the start peak current X within a floor brush start peak duration t and sending a start peak current detection signal to the control unit;

S3: the control unit providing a corresponding stall current A according to the start peak current detection signal;

S4: the floor brush current detection module detecting the normal operating current Y after the floor brush start peak duration t and sending a normal operating current detection signal to the control unit;

S5: the control unit controlling the operation of the floor brush according to the normal operating current detection signal:

wherein the electric motor in the floor brush stops if the normal operating current Y is larger than or equal to the stall current A, and wherein the electric motor in the floor brush maintains the operating state if the normal operating current Y is smaller than the stall current A.

It shall be noted that the control method provided by this embodiment is applicable not only to the hand-held vacuum cleaner, but also to vacuum cleaners in other forms that are provided with the control unit and the floor brush current detection module as described above and can achieve the control logic of the foregoing method, such as a horizontal vacuum cleaner, an upright vacuum cleaner and the like.

The operating process of a vacuum cleaner will be described below by way of example in combination with the hand-held vacuum cleaner shown in FIG. 1. The operating process is specifically as below:

For example, a floor brush assembly 300 of the hand-held vacuum cleaner comprises two different floor brushes: a first floor brush and a second floor brush, wherein the first floor brush has a stall current A1, and has the corresponding start peak current X1-X2, and the second floor brush has a stall current A2, and has the corresponding start peak current X3-X4. Those skilled in the art would have stored the above-mentioned correspondences in a control unit when designing and manufacturing a hand-held vacuum cleaner. When a user uses the hand-held vacuum cleaner, floor brushes may be selected and installed according to actual needs.

Cleaning is performed after the user installs a particular floor brush. At this time, the hand-held vacuum cleaner is powered on, and the floor brush current detection module detects the start peak current X within a floor brush start peak duration t and sends the start peak current X to the control unit. If X is in the range X1-X2, the control unit provides the stall current A1 corresponding to the floor brush according to the start peak current and the preset correspondence between the peak start current range and the stall current, that is, A is A1. If X is in the range X3-X4, the control unit provides the stall current A2 corresponding to the floor brush according to the start peak current and the preset correspondence between the peak start current range and the stall current, that is, A is A2. The stall current corresponding to the floor brush is obtained thereby according to different start peak currents.

Then the floor brush current detection module detects the normal operating current Y of the floor brush after the floor brush start peak duration t and sends the normal operating current Y to the control unit, so that the control unit controls the operating state of the electric motor of the floor brush according to the normal operating current Y and the above obtained stall current A of the floor brush. For example, if the normal operating current Y is larger than or equal to the stall current A, the control unit controls the electric motor in the floor brush to stop operating; and if the normal operating current Y is smaller than the stall current A, the control unit controls the electric motor in the floor brush to maintain the operating state. Thus, the electric motor may be protected and the probability of burnout of the electric motor of a floor brush due to operating in an abnormal state for long time can be reduced. For example, the electric motor idles when the floor brush is entangled with hair.

In summary, according to the embodiments of the present disclosure, by providing the floor brush current detection module to detect the start peak current and the normal operating current of a floor brush, providing the stall current of the floor brush depending on the start peak current of the floor brush and the correspondence between the start peak current range and the stall current preset in the control unit, and then determining whether the floor brush is in abnormal operation by comparing the stall current of the floor brush with the normal operating current, the electric motor can be protected and the probability of burnout of the electric motor due to abnormally operating for long time can be reduced. Thus, the problem of unstable operation of the whole machine can be avoided as much as possible, which is conducive to eliminating potential safety hazards.

What is claimed is:

1. A vacuum cleaner comprising:

a vacuum cleaner body provided with a control unit and a detection unit;

a plurality of different motor driven floor brushes for performing different types of cleaning work;

an extension tube connecting the vacuum cleaner body and a selected motor driven floor brush of the plurality of different motor driven floor brushes, wherein the detection unit is configured to measure a starting peak current and a normal operating current of an electric motor of the selected motor driven floor brush;

wherein the control unit is configured to:

match the measured starting peak current to a preset starting peak current range;

determine a preset stall current for the selected motor driven floor brush based on the preset starting peak current range;

operate the selected motor driven floor brush according to the normal operating current; and stop the selected motor driven floor brush in response to the determined preset stall current being detected.

2. The vacuum cleaner of claim 1, wherein matching the measured starting peak current includes matching the measured starting peak current to preset correspondences between starting peak current ranges and stall currents of the plurality of motor driven floor brushes.

3. The vacuum cleaner of claim 2, wherein the control unit is further configured to preload the correspondences between the start peak current ranges and the stall currents of the plurality of motor driven floor brushes.

4. The vacuum cleaner of claim 2, wherein the start peak current ranges of the plurality of floor brushes included in the correspondences do not overlap each other.

5. The vacuum cleaner of claim 1, wherein when operating the electric motor to maintain an operating state or stop the operating state, the control unit is further configured to:

control the electric motor to stop the operating state in response to a measured operating current of the electric motor being larger than or equal to the preset stall current; and control the electric motor to maintain the operating state in response to the measured operating current being smaller than the preset stall current.

6. The vacuum cleaner of claim 1, wherein the detection unit is further configured to:

measure the starting peak current of the electric motor of the selected motor driven floor brush within a starting peak duration (t) of when the electric motor of the selected motor driven floor brush is started;

send the starting peak current to the control unit;

measure the normal operating current of the electric motor of the selected motor driven floor brush after the starting peak duration (t); and send the normal operating current to the control unit.

7. A control method of a vacuum cleaner, comprising:

measuring a starting peak current and a normal operating current of an electric motor of a motor driven floor brush which is being used with the vacuum cleaner, wherein the motor driven floor brush is selected from a plurality of different motor driven floor brushes;

matching the measured starting peak current to a preset starting peak current range;

determining a preset stall current for the selected motor driven floor brush based on the preset starting peak current range:

operating the selected motor driven floor brush according to the normal operating current; and stopping the selected motor driven floor brush in response to the determined preset stall current being detected.

8. The control method of claim 7, wherein measuring the starting peak current and the normal operating current comprises:

measuring the starting peak current of the electric motor of the selected motor driven floor brush within a starting peak duration (t) of when the electric motor of the selected motor driven floor brush is started; and measuring the normal operating current of the electric motor of the selected motor driven floor brush after the starting peak duration (t).

9. The control method of claim 7, wherein operating the electric motor to maintain an operating state or stop the electric motor comprises:

controlling the electric motor to stop the operating state in response to a measured operating current of the electric motor being larger than or equal to the preset stall current; and controlling the electric motor to maintain the operating state in response to the measured operating current being smaller than the preset stall current.

10. The control method of claim 7, wherein before starting the vacuum cleaner, the method further comprises:

initializing, and preloading correspondences between starting peak current ranges and stall currents of the plurality of motor driven floor brushes.

11. The control method of claim 8, wherein the starting peak duration (t) has a range of 0 ms to 20 ms.

12. The control method of claim 11, wherein the starting peak duration (t) is 10 ms.

* * * * *